United States Patent [19]

Kundert

[11] 4,004,799

[45] Jan. 25, 1977

[54] RECONSTRUCTIBLE KARATE BOARD

[75] Inventor: Robert L. Kundert, Madison, Wis.

[73] Assignee: Focus/Board Inc., Madison, Wis.

[22] Filed: Apr. 7, 1975

[21] Appl. No.: 565,910

[52] U.S. Cl. ..... 272/8 N; 272/76; 46/31

[51] Int. Cl.[2] ..... A63J 5/00

[58] Field of Search ..... 272/76, 8 N, 8 R, 27 R, 272/27 N; 35/69, 102.1 C; 46/16, 17, 26, 31; 273/102 A, 102 AP

[56] References Cited

UNITED STATES PATENTS

| | | | |
|---|---|---|---|
| 2,582,553 | 1/1952 | McMurtrie | 46/26 |
| 2,714,269 | 8/1955 | Charles | 46/26 |
| 2,735,146 | 2/1956 | Purviance | 46/26 X |
| 3,076,286 | 2/1963 | Czecholinski | 46/26 X |
| 3,883,135 | 5/1975 | Milliken | 272/8 N |

*Primary Examiner*—Richard C. Pinkham
*Assistant Examiner*—T. Brown
*Attorney, Agent, or Firm*—Andrus, Sceales, Starke & Sawall

[57] ABSTRACT

A karate board includes a pair of pine board members equal in size to one-half of the karate board. A releasable edge connection includes similar channels firmly affixed to the joinder edge of each board. Each of the channels includes a connecting slot having a reduced neck portion. The abutting channel faces are planar with the reduced neck portions in alignment and a key extends through the adjacent neck portions with inner enlargements which firmly interlock the board members together. The channel members and the key member are formed of plastic which is slightly flexible and of a low friction coefficient. The outer edges of the abutting channel faces are rounded. The neck portions are circular with the axis in the abutting faces and the enlargements of the key are also circular to provide rolling surfaces. A conventional karate force applied to the assembled board members separates the key member moving from one of the channel slots with a snap-action essentially the same as breaking of a pine board and without damage to the board or to the key connection means thereby producing a readily reconstructible karate board. A plurality of different keys with different cross sections establish different holding forces associated with the various levels of karate.

13 Claims, 7 Drawing Figures

RECONSTRUCTIBLE KARATE BOARD

BACKGROUND OF THE INVENTION

This invention relates to a karate board and particularly a reusable karate board such as employed in karate training demonstrations and the like.

The art of karate is an old and honorable form of self-defense and physical development. The art has more recently become widely accepted in the Western World and the number of karate students and active participants has significantly increased, with an increasing number of training and practice associations in which the students progress through the various stages. As a part of the teaching and training, the student's ability is, in part, developed by the striking and breaking of relatively flat karate boards by the hands, feet, elbows, knees and head. Generally, such board is a standardized wooden pine board approximately 1 foot square and 1 inch thick. The board is normally supported along the opposite sides and is broken by the student applying his feet, hands, head, or the like to the central portion of the board. As the skill and physical strength of the student increases he is able to break each board and even a stack of such boards. This conventional method of development has been widely employed. Such boards are relatively expensive and applicant has realized that in fact a very significant total cost is involved and with the increasing interest in karate, problems are encountered in maintaining an adequate supply.

Summary of the Present Invention

The present invention is particularly directed to a reconstructable and reusable karate board which can be employed in the development of the art of karate. Generally, in accordance with the present invention, a pair of adjacent board members, defining the usual karate board configuration, are interconnected by a releasable key and slot type connection means along longitudinally extended edges centrally of the board configuration. The key and slot type connection separates under an appropriate applied normal force in essentially the same manner as the conventional karate board breaks. In accordance with a further novel aspect of the present invention, the key and slot type connection is constructed to permit selective adjustment of the holding force and thereby establish an adjustable required breaking force to simulate the continued development normally encountered in the art of karate.

More particularly in accordance with a particular unique embodiment of the present invention, a pair of similar board members, generally equal in size to one-half of the current conventional karate board, are provided and preferably formed of a suitable laminate substance, grained wood, plastic, or lightweight metal or the like similar to the conventional karate board. The adjoining edges are provided with special connection means including similar channels firmly affixed to the joinder edge of each board in any suitable manner. Each of the channels includes a connecting slot which is similarly constructed with a reduced neck or entrance portion. The adjoining channel faces are planar and the board members are located with the faces in abutting relation and with the reduced neck portions in alignment. A key extends through the adjacent neck portions and includes inner offset portions within each of the channels to firmly interlock the members to each other. The channel members and the key member are preferably formed of a material having at least some degree of resilient flexibility, such as a nylon, other suitable plastic material, or the like. When the board members are assembled with the key within the channels, the board members are interlocked to form a flat board which requires a predetermined breaking force applied normally to the main plain and directly centrally thereof. A novel indication of the board is the development of focal accuracy by the student because the degree of breaking difficulty increases sharply if the center seam is missed by the striking blow. This accuracy or "focus" is stressed in all techniques and specifically in breaking techniques, hence this uniqueness in the rebreakable board is an advantage. The force can be readily selected to be of the order of a conventional karate force. When such force is applied the board members separate with the key member moving from one or both of the channel slots. The key and slots are preferably formed with smooth mating surfaces which prevent lockup between them as the board members separate. The flexible plastic will give sufficiently to allow the forced separation only. In essence the key member will snap out of one of the slots defined by the one channel without damage to the board or to the key and thereby produce a readily reconstructible karate board.

In accordance with a further aspect of a particular novel and unique embodiment of the invention, a plurality of key members are formed with different cross sections to establish very different holding forces and thereby effect the particular strength connections associated with the various levels of karate. In this manner, a very simple board construction provides a long life and permits development through the various levels of karate.

More particularly in a preferred construction, of the present invention the channels have a beaker shaped cross section with the neck portions formed with a radius to an essentially minimum opening at the flat abutting adjoining face or edge face. In the abutting relations the abutting neck portions define a continuous smooth radius into a relatively large inner portion. The connecting key is formed as a generally rectangular member having an inner concave portion aligned with and spaced from the mating neck portion of the channels and having smooth circular sealing portusions which provide an essentially limited or line contact with the curved neck portions. Applicant has found that with this construction the key members readily separate under the desired force characteristic and different sized key members are readily employed to vary the location of the force bearing lines within the channel to thereby readily vary the required force. As the key is enlarged the required separating force is increased and readily adapts a single board construction to the sequential development of the karate art.

The present invention thus provides a simple reliable and inexpensive system of maintaining a karate board unit for the development of the karate art.

BRIEF DESCRIPTION OF THE DRAWING

The drawing furnished herewith illustrates the best mode presently contemplated for carrying out the invention and clearly discloses the above advantages and features as well as others which will be readily understood from the description of such illustrated embodiment.

In the drawing.

DESCRIPTION OF ILLUSTRATED EMBODIMENTS

Figure 1:
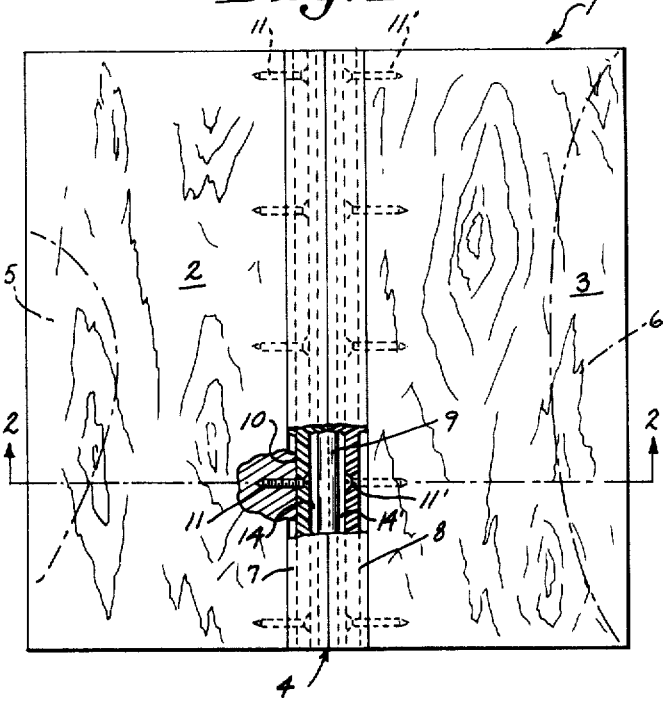
FIG. 1 is a plan view of a karate board having a novel connection means constructed in accordance with the present invention.
Figure 5:
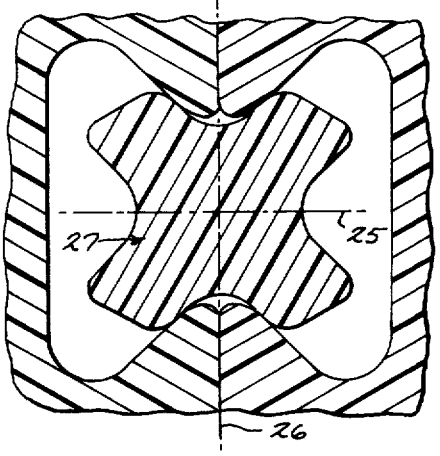
FIG. 5 is a further view similar to FIGS. 2 and 4 showing still a further embodiment.
Figure 2:
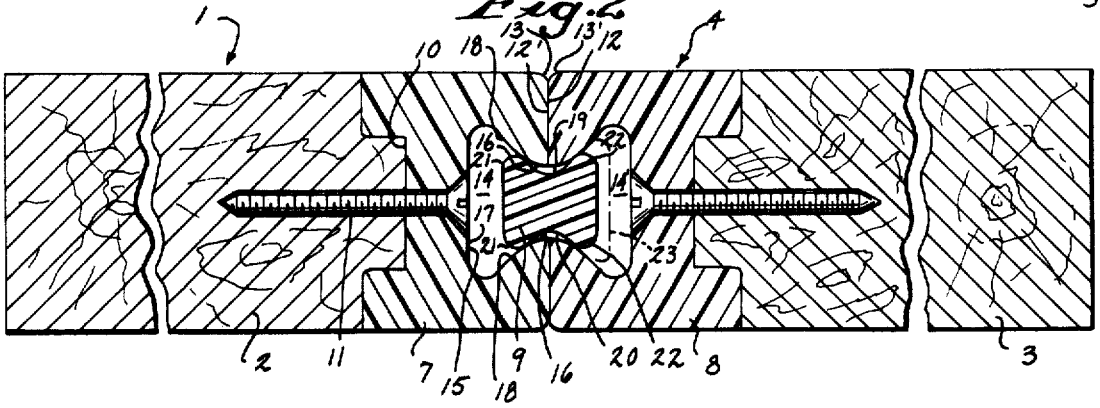
FIG. 2 is an enlarged vertical section taken generally on line 2—2 of FIG. 1 and clearly illustrating the cross sectional construction of the reconstructible karate board.

Referring to the drawing and particularly to FIGS. 1 and 2, a karate board 1 constructed in accordance with the present invention is illustrated including a first and second board member 2 and 3 forming the opposite halves of the board and interconnected on a longitudinal central portion of board 1 by a special releasable connector means 4 constructed in accordance with the teaching of the present invention and clearly illustrating a preferred embodiment of the present invention. The illustrated karate board 1 may be formed with conventional dimensions and particularly be approximately 1 foot square and of essentially 1 inch thick. Each of the board members 2 and 3 is essentially equal to one-half of the total width of the board 1 and, in the assumed construction, would have a length of 1 foot and a width of approximately 6 inches including the joinder portions of the connection means 4, which is secured to the center joinder edges of the board members 2 and 3, and which particularly forms the subject matter of the present invention. The connection means 4 extends throughout the center of board 1 between the opposite sides which define the support areas, shown in phantom at 5 and 6. In operation, the board 1 is held at areas 5 and 6 and the student strikes the board in the area of the connection means 4. If struck with appropriate skill and force, the connection means 4 separates with essentially the same action as a standard pine board. As presently developed, however, connection means 4 may be reassembled and the board again immediately employed for a further strike.

The connection means 4 in the illustrated embodiment of the invention generally includes similar slotted connecting channels 7 and 8 secured to the opposing center edges of the board members 2 and 3 and releasably interconnected by a channel key 9 which couples to the respective channels. As each of the channel members 7 and 8 is essentially identically constructed, the one channel 7 will be described in detail with the corresponding elements of the other channel 8 identified by corresponding primed numbers.

More particularly, channel 7 generally includes a U-shaped attachment edge having an intermediate recess 10. The edge of the board member 2 is correspondingly configured with a centrally located projection which mates with recess 10. The channel 7 is affixed to the edge of the board member 2 in any suitable manner such as by suitable adhesive and/or interconnecting, attachment screws 11 which pass through the base portion of the channel 7 and into the edge of the board member 2. The outer or opposite edge portion of the channel 7 is formed as a flat or planar face 12 adapted to abutt corresponding edge or face 12′ of the opposed channel 8. The top and lower corners of the channel 7 are preferably provided with a smooth curved surface 13 to permit the slight rolling movement thereof with respect to corresponding corner 13′ when the board members 2 and 3 separate.

The central portion of the channel 7 includes a beaker or bottle-shaped recess or slot 14 which opens laterally into alignment with the corresponding slot 14′ of the opposed channel 8. The slot extends longitudinally throughout the length of the channel 7, in the illustrated embodiment of the invention, and includes an inner enlarged portion 15 having a generally truncated or triangle cross section and an outer neck portion 16. The truncated portion 15 is formed with a relatively flat base 17 and curved connecting ends to inwardly extending, generally linear or flat side walls 18. The side walls 18 connect to the neck portions 16 which are formed with a distinct radius to provide a smooth, circular, gradual change in the wall configuration immediately adjacent to the connecting and abutting face of the channel 7. The axis of the neck portion lies on faces 12—12″.

Figure 3:
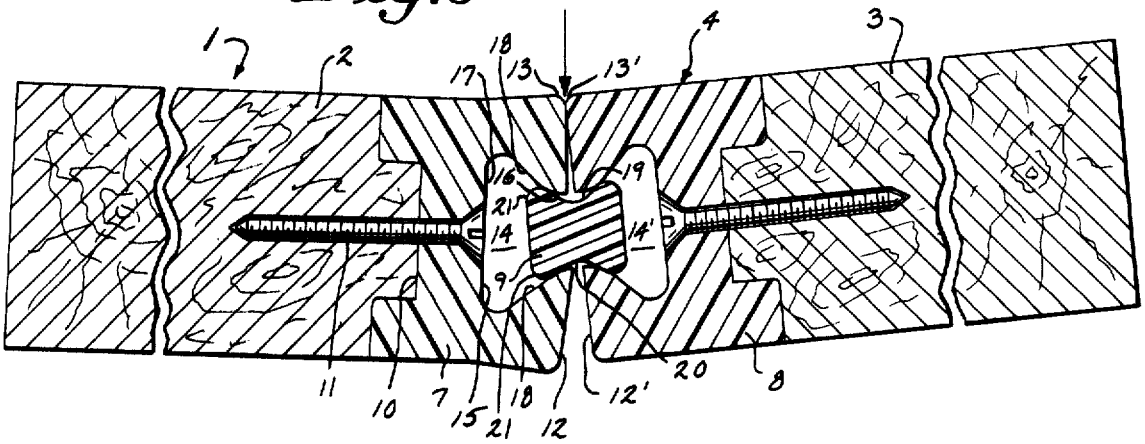
FIG. 3 is a sectional view showing the board breaking or separating along the connection means of FIGS. 1 and 2.

The channels 7 and 8, as previously noted, are formed with similar slots 14 and 14′ and thus the neck portions define a continuous curved junction, which, with the preferred circular configuration, defines a continuous circular surface of a predetermined radius. Thus, each neck portion provides a curve, which, in essence, provides a slightly progressively reduced opening to the channel from the maximum opening at the plane of separation. Thus, with the abutted connection, as shown in FIG. 3, the channel slots 14 and 14′ define a generally hourglass-shaped configuration with a smooth curved intermediate neck portion.

The key 9 which extends into the channel slots 14 and 14′ to provide interconnection thereof is generally of a reduced hourglass-shaped configuration in the preferred construction of the invention. Thus, generally, the key 9 is symmetrically formed through the connecting or abutting joint of the connection means 4 and includes inner, concave, curved portions 19 and 20 to the opposites which merge with similar smooth curved connecting end portions or members 21 within slot 14 and similar members 22 within slot 14′. The compound curved construction of the side wall of key 9 defines an essential line contact between the coupling members 21 and 22 and the curved neck portions or the side walls of the slots 14 and 14′, as particularly shown in FIG. 2. The illustrated construction further provides a rolling surface between the members of the connection means 4 during the breaking of the board 1.

In the operation of the device, the key 9 provides a firm interconnection of the board members 2 and 3. When a blow is struck to the board 1 at or adjacent to the connection means 4 with sides of the board firmly held along the opposite sides as at the holding areas 5 and 6, the keyed connection will respond to a selected force to permit the separation of *t* the board members 2 and 3. The key effectively separates and moves from one or both of the slots 14 or 14′. The rolling contact permits a smooth, uninterrupted movement of the key 9 from a channel slot 14 or 14′ wthout breakage of either the channel or the key member. Further, the channels, and particularly the lips formed by the neck portions, are formed of a suitable, slightly flexible material which permits some degree of flexure, as shown, for example, in FIG. 3, thereby contributing to the proper removal of the key and separation of the board without breakage of the members, particularly with a snap action.

The connection means 4 and particularly both channels 7 and 8 and key 9 may be advantageously formed of a suitable, molded plastic material which has the desired degree of flexibility. For example, Applicant has found that the use of a nylon material manufactured and sold by the DuPont Company under the trademark "Zytel 101" provides a highly satisfactory material. The surface characteristic is such as to permit the ready, repeatable movement of the connection member surfaces relative to each other and also has a sufficient degree of flexibility to readily permit the members to separate without undue breakage.

In a practical construction, the channels and key were formed of the Zytel 101 Nylon approximately 1 inch thick with the following approximate dimensions of the connection means. The recess had a neck opening slightly less than 0.35 inches and a maximum outer dimension of 0.35 inches and the key was approximately 0.35 inches square. The neck portion of the slots were formed with a radius of 0.18 inches. The channel slot had a depth of approximately 0.33 inches and a total width at the base of approximately 0.59 inches. The board members are preferably formed of a conventional laminate substance to establish an essentially similar vibration characteristic to that actually encountered with a karate board.

In summary, the application of a karate force to a board 1 constructed in accordance with this invention has been found to result in an essentially snap-action removal of the key from the slot to closely simulate the breaking of a pine board. The reconstructable construction, of course, permits the direct reconnection of the assembly either by merely snapping of the key member 9 into the slotted channels or the introduction through an open end, if constructed as shown in FIGS. 1 – 3. Repeated breaking of a board, as shown in FIGS. 1 – 3, has shown an extreme durability and accurate repeatability in the characteristic of the required breaking forces. The board is, therefore, highly acceptable and desirable in the art of karate development.

Although the illustrated embodiment provides a particularly satisfactory and practical construction in use and economical construction, any other suitable interconnection means can, of course, be employed. For example, the recessed edge members could be formed of a very rigid material with suitable resilient surface means at the more significant areas. Such recesses could, of course, also be formed directly in a board of any suitable material. Further, the key might be integrally formed in one board member but the danger of breakage is increased.

The use of the separate key member is further particularly unique and of significance in the karate art as the key size may be varied to change the expertise required to separate or break the board 1.

For example, as shown in phantom at 23 in FIG. 2, increasing the size of a key 9 moves the bearing or connecting line inwardly of the abutting faces which will effectively increase the holding force while still permitting separation of the members. The location of the locking or bearing surfaces of the key member increases the leverage arms and correspondingly the force to separate or snap the board apart. This, thus, effectively increases the force requirements and/or the skill in application of the force and thereby demands a higher level of development. In this manner, a single board structure may be employed with the plurality of key members for persons of different levels or for a person to effectively proceed through the development of the karate art. The different keys could, of course, be directly color coded in accordance with the various stages of the karate development including the white, yellow, green, purple, brown, and black belt scales which indicate the level to which the student has progressed.

Figure 4:
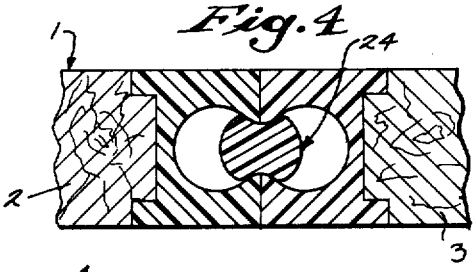
FIG. 4 is a view showing an alternate construction.

Although shown in a preferred construction with the curved, and hourglass-shaped connecting configuration, any other shape can, of course, also be employed. For example, a more conventional semicylindrical or bulb-shaped connection means 24 such as shown in FIG. 4 may be employed.

Similarly, a key may be formed with offset locking enlargements which are symmetrical about both perpendicular axii 25 and 26 of the key. For example, referring to FIG. 4 to permit introduction of the key in various matters in either one of two matters and with the key size offset such that a single key will effectively develop two different holding characteristics.

Thus, the present invention provides a highly improved replaceable or reconnectable karate board which can significantly contribute to the development of the art of karate.

Various modes of carrying out the invention are contemplated as being within the scope of the following claims, particularly pointing out and distinctly claiming the subject matter which is regarded as the invention.

I claim:

1. A karate board adapted to be split by selective force application to the central portion thereof, comprising a board member having a first joinder edge, a board member having a second joinder edge, said board members being generally elongated similar shaped flat members each having a thickness substantially less than its width and length, said joinder edges having a channel and interlocking key connection means for releasably joining of the board members to form a keyed planar karate board, said connection means being constructed including an elongated edge channel having at least one lip at its opening and having an inner base portion having a width substantially larger than the width of said opening, and an elongated edge key having a generally corresponding enlargement mating with said edge channel, said edge key and channel firmly connecting said board members in coplanar relationship and holding said board members against lateral separation in the plane of the board members and transverse of the length of said key when said enlargement of said key is lockingly engaged in said opening by said lip at said opening said lip and said enlargement defining a deformable releasable connection in a direction generally perpendicular to said board and with the edge key snapping outwardly of said channel without noticable disruption of the channel or key in response to a karate force applied to the keyed board in alignment with the connection means.

2. The karate board of claim 1 wherein said channel and key connection means includes a channel in each of said board members and said key is a replaceable key mating with each channel.

3. The karate board of claim 1 wherein said channel said key are formed of low friction plastic having a limited degree of flexibility.

4. The karate board of claim 2 and including a plurality of keys each having a different cross-section to vary the holding force and correspondingly vary the breaking force.

5. The karate board of claim 2 wherein said connection means includes plastic edge members secured to the board members and each edge member having one of said channels said key having oppositely located enlargements adapted to mate within said channels to hold said edge members in abutting relation and snapping outwardly of at least one of said channels in response to application of a karate blow to the keyed board member.

6. A karate board comprising a pair of similar elongated similar shaped flat board members each having a thickness substantially less than its width or length and having a joinder edge, a separable replaceable connecting means for securing said board members in an edge to edge relationship, said connecting means including a pair of corresponding channel members fixedly secured one each to each edge said joinder edges, each of said channel members having flat edge faces located in abutting relation in the connected position of said board members and including a centrally located coupling channel, each of said coupling channels having an entrance neck portion defining a pair of locking projections having a limited flexibility and an inner enlarged base portion spaced inwardly of the projections, an elongated key member; said key member having at least one pair of opposed enlarged portions and a reduced portion intermediate said enlarged portions, each of said coupling channels of said connecting means receiving an enlarged portion of said key member and said reduced intermediate portion of said key member receiving a projection of each of said chambers when said board members are connected in said edge to edge relationship said edge channels and key member forming a non-breaking deformable releasable connection firmly connecting said board members in coplanar relationship and preventing separation of the flat board members in the plane of the board members and transverse of said joinder edges and with the edge key snapping outwardly of said channel without noticable disruption of the channels and key in response to a karate force applied to the keyed board member.

7. The karate board of claim 6 wherein said board members are formed of pine wood, said channel members being formed of material having a limited flexibility and low friction coefficient.

8. The karate board of claim 6 wherein said board members are flat and said locking projections being rounded to define adjacent rolling surfaces at said entrance neck portion.

9. The karate board of claim 6 wherein said neck portion is a curved surface and said enlarged portion of key member are substantially curved and are substantially parallel aligned with and positioned inwardly of said neck portion when said board members are connected.

10. The karate board of claim 6 wherein each of said board members is formed of wood and, said channel members being plastic and being connected to said joinder edges to define a planar extension of said board member, said projectors being rounded at said entrance neck portion to define adjacent rolling surfaces for snapping of said key member from said channel member of the connecting means, and said enlarged base portion of said channel member including linear sidewalls extending from said rounded neck portion when said board members are connected.

11. The karate board of claim 6 wherein said channel members and said key member are formed of plastic having a low friction coefficient and a low level of flexibility whereby said locking projection is resiliently deformed in response to application of a karate force to break said board with a snap action response.

12. A karate board, comprising a pair of similar rectangular board members formed of pine wood and having corresponding joinder edge means along the longest length of the member, a separable replaceable connecting means secured to said joinder edges and including a pair of corresponding channel members fixedly secured one each to each of said joinder edges, and including a centrally located coupling slot, said channel members having flat and parallel edge faces located in abutting relation in the connected position of the connecting means, the outer edges of said faces being rounded to define adjacent rolling surfaces for the opening of the connecting means, each of said coupling slots having a rounded neck portion and inner enlarged base portion defining a pair of locking lip means, said channels being formed of a plastic material permitting limited deflection of said locking lip means and a solid plastic key member extended through the neck portions with enlarged opposite inner rounded coupling portions engaging the slots inwardly of said edges.

13. The karate board of claim 12 wherein said rounded neck portion is a rounded surface, said key member has a generally square cross-section and includes opposed concave portions aligned with the edge faces and adjacent neck portion and said coupling portions engaging the slots inwardly of said edges.

* * * * *

UNITED STATES PATENT AND TRADEMARK OFFICE

CERTIFICATE OF CORRECTION

PATENT NO. : 4,004,799

DATED : January 25, 1977

INVENTOR(S) : ROBERT L. KUNDERT

It is certified that error appears in the above-identified patent and that said Letters Patent are hereby corrected as shown below:

| | | | | |
|---|---|---|---|---|
| Column | 5, | Line | 41, | before "open" cancel "an" and insert --- the ---; |
| Column CLAIM 3 | 7, | Line | 1, | after "channel" (end of line) insert --- and ---; |
| Column CLAIM 5 | 7, | Line | 11, | after "channels" insert --- and ---; |
| Column CLAIM 6 | 7, | Line | 25, | after "edge" (second occurrence) cancel "edge"; and after "joinder" cancel "edges" and insert --- edge ---; |

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*